US006557849B2

(12) United States Patent
Wyss

(10) Patent No.: US 6,557,849 B2
(45) Date of Patent: May 6, 2003

(54) SHEET HANDLING APPARATUS

(75) Inventor: Daniel Wyss, Bern (CH)

(73) Assignee: Da la Rue International (GB)

( * ) Notice: Subject to any disclaimer, the term of this patent is extended or adjusted under 35 U.S.C. 154(b) by 21 days.

(21) Appl. No.: 09/885,029

(22) Filed: Jun. 21, 2001

(65) Prior Publication Data

US 2002/0195769 A1 Dec. 26, 2002

(51) Int. Cl.[7] ..... B65H 7/02
(52) U.S. Cl. ..... 271/259
(58) Field of Search ..... 271/258.01, 259, 271/260, 261

(56) References Cited

U.S. PATENT DOCUMENTS 4,516,899 A * 5/1985 Wood et al. ..... 271/258.01
4,669,393 A 6/1987 Wuthrich
4,871,125 A 10/1989 Haueterq
5,322,274 A * 6/1994 Takahashi et al. ..... 271/258.01
5,815,766 A * 9/1998 Miller et al. ..... 271/259
5,833,229 A * 11/1998 Prim ..... 271/258.01
6,032,944 A * 3/2000 Lee ..... 271/258.01

* cited by examiner

*Primary Examiner*—John M. Jillions
(74) *Attorney, Agent, or Firm*—Oliff & Berridge, PLC.

(57) ABSTRACT

Sheet handling apparatus includes a transport system for transporting sheets; a sensing system for monitoring the passage of sheets; and a controller. The controller determines, during a transaction involving the transport of one or a sequence of sheets, the existence of a jam condition from the sensing system. If a jam condition exists, the controller operates the transport system to attempt to release the jammed sheet. If at least three attempts to release the jammed sheet fail, the controller stops the current transaction.

3 Claims, 6 Drawing Sheets

SHEET HANDLING APPARATUS

FIELD OF THE INVENTION

The invention relates to sheet handling apparatus such as sheet acceptors, sorters, recirculators and the like. Such sheet handling apparatus is used in a variety of applications, particularly for handling documents of value such as banknotes, cheques, postal orders and the like.

DESCRIPTION OF THE PRIOR ART

Due to the varying condition of sheets, a common problem with sheet handling apparatus is the risk of sheets jamming. In some cases, the apparatus will normally shut down and the jammed sheet will need to be manually removed. This leads to significant downtime and often requires a specialist user to deal with the problem.

In more sophisticated systems, an auto purge process can be enabled. Thus, when a jam condition is sensed, the auto purge process will be run in an attempt to release the jam. If the system determines that the jam has been released, then the transaction will be continued but otherwise the transaction will be stopped. However, a problem has arisen with this approach in that the system for sensing the presence of a jam can occasionally suggest that the jam has been cleared when in fact it has not. This may be because a sensor is located at a position such that the auto purge process has moved a sheet just clear of the sensor but the cause of the jam has not been removed. As a result, the system can enter an endless loop which has to be manually detected and dealt with.

SUMMARY OF THE INVENTION

In accordance with the present invention, sheet handling apparatus including a transport system for transporting sheets; a sensing system for monitoring the passage of sheets; and a controller system for determining, during a transaction involving the transport of one or a sequence of sheets, the existence of a jam condition from the sensing system, and, if a jam condition exists, a) operating the transport system to attempt to release the jammed sheet, b) determining if a jam condition still exists, and ci) if it does, stopping the transaction and, cii) if it does not, attempting to continue the transaction and wherein if the controller system determines that during a transaction a predetermined number of attempts to release the jammed sheet have been made, the controller system stops the transaction.

In order to avoid the endless loop problem mentioned above, in the present invention the controller system monitors the number of attempts made to release a jam and if a predetermined number is reached, it will stop the transaction. In this way, the system avoids entering an endless loop.

Typically, the predetermined number of attempts is three although two or more could also be chosen.

In order to attempt to recover from a jam condition the transport system is suitably controlled. For example, the transport system can be moved temporarily in reverse or slowly or rapidly to and from. Where the transport system includes one or more sheet stores and associated diverters, the control system may cause the or each diverter to move to and from, for example in a fluttering motion.

If the transport system includes one or more sheet stores in the form of roll storage modules (such as described in U.S. Pat. Nos. 4,669,393 and 4,871,125) then the control system may cause the or each roll storage module to operate in a direction opposite to its current operating direction.

The controller system may be implemented using a single controller such as a microprocessor but would typically be implemented in a distributed manner as described in more detail below.

An example of a banknote recirculating system according to the present invention will now be described with reference to the accompanying drawings, in which:—

Figure 1:
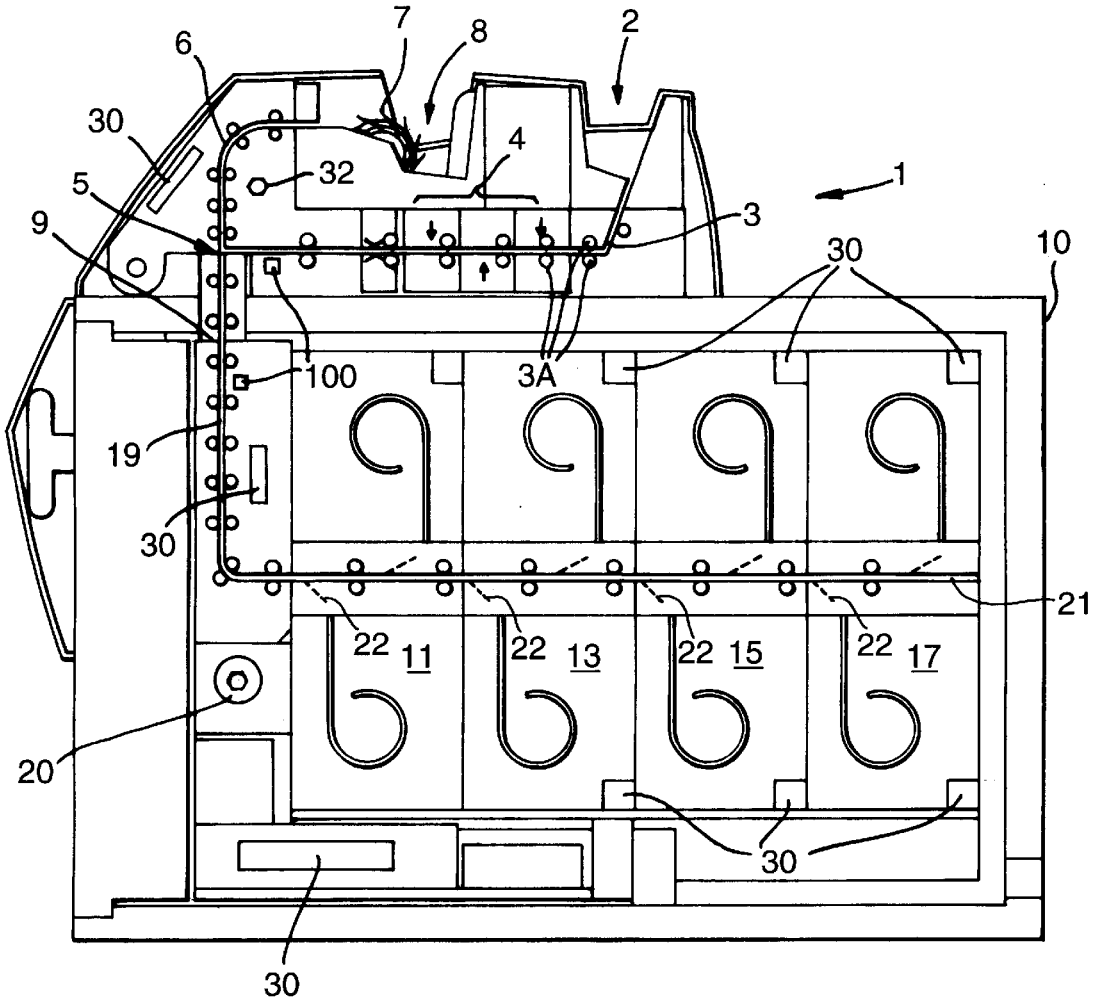
FIG. 1 is a schematic view of the banknote recirculating system.

The banknote recirculating system shown in FIG. 1 corresponds to the De La Rue TCR Twin Safe banknote recirculator and will therefore not be described in detail. The system comprises a note handling module 1 including an input hopper 2 into which banknotes to be deposited are placed. A set of transport rollers shown schematically at 3A feed the notes singularly from the stack in the hopper 2 along a feed path 3 past a series of detectors 4 for detecting information, such as denomination and authenticity, to a diverter 5 which can be controlled either to pass the notes up through an exit path 6 to a stacker wheel 7 where the sheets are stacked in an output hopper 8 or through an opening 9 to a path 19 in a safe 10 in which are located a set of eight Roll Storage Modules (RSMs) 11–18.

The notes are fed along the path 19 defined by further rollers of the transport system driven by a motor 20 into a path 21 extending between the roll storage modules 11–18. Associated with each roll storage module 11–18 is a diverter 22 which can be selectively activated to connect the path 21 with the appropriate RSM.

In normal operation, the system shown in FIG. 1 can be operated in either a deposit mode or a withdrawal mode. The system is controlled by a distributed microprocessor system shown schematically at 30.

In the deposit mode, a set of banknotes which may be of the same or mixed denomination is placed in the input hopper 2 and the distributed microprocessor system 30 activates a motor 20 or 32 to cause the appropriate part of the transport system to draw the notes singularly from the input hopper 2 along the feed path 3. The detectors 4 identify each note and this information is passed back to the distributed microprocessor system 30. If successfully identified, the distributed microprocessor system 30 sets the diverter 5 to cause each note to pass down into the safe 10 along the path 19, the rollers of the transport defining the path 19 being operated by the motor 20 under the control of the distributed microprocessor system 30 so that the notes are then fed into the safe 10. Depending upon the denomination of the note, an appropriate one of the RSMs 11–18 is activated, for example the RSM 14 and at the same time the diverter 22 associated with that RSM is placed in its divert state shown in dashed lines in FIG. 1 so that the note is diverted into the RSM.

During a deposit operation, if a note cannot be identified or is not authentic then the diverter 5 is activated to divert the note immediately along the path 6 under the control of a motor 32 to the output hopper 8.

In a withdrawal mode, the operator indicates via a keyboard or the like (not shown) to the distributed microprocessor system 30 the mix of bank notes of the currency he wishes to withdraw and the distributed microprocessor system then determines their locations in the RSMs 11–18. The motors 20, 32 are then activated together with the appropriate RSMs 11–18 and their associated diverters 22 so that the appropriate banknotes are withdrawn from the corresponding stores, fed along the path 19 past the diverter 5, along the path 6 to the output hopper 8.

The present invention is concerned with methods for automatically dealing with a jammed sheet within the system.

Throughout the apparatus shown in FIG. 1 there are provided note sensors, only two of which 100 are shown in FIG. 1, which are typically optical and monitor the passage of notes, this information being reported back to the distributed microprocessor system 30 so that the distributed microprocessor system can track accurately the location of each note in the system. In this way, the distributed microprocessor system 30 can detect the existence of a jam when, for example, a note fails to arrive at a sensor at an expected time or stops at a position at which it can be sensed.

Figure 2:
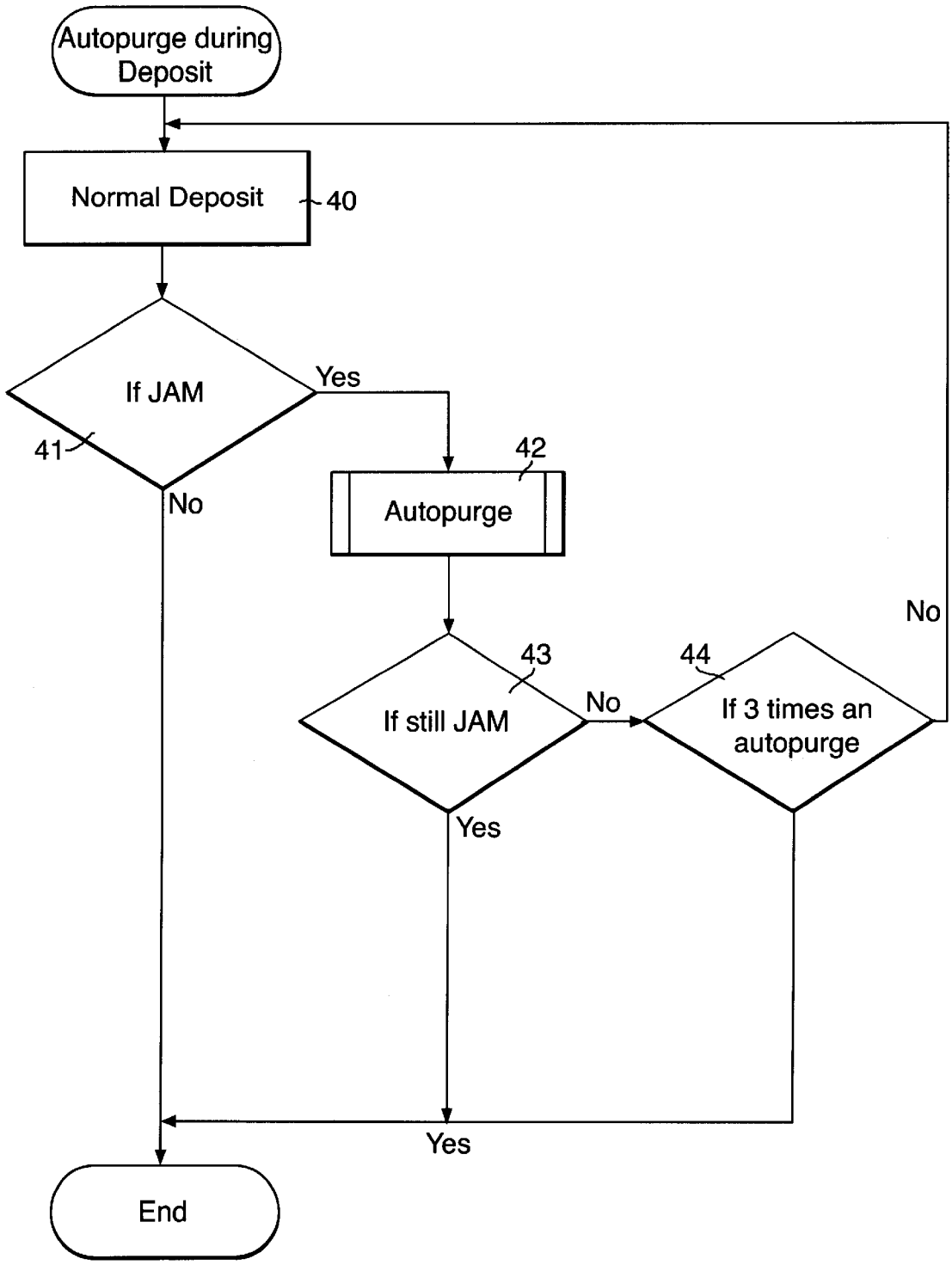
FIGS. 2 to 6 are flow diagrams illustrating operation of the system shown in FIG. 1.

FIG. 2 illustrates the overall operation of the distributed microprocessor system 30 during a deposit transaction. Thus, during a normal deposit 40, the distributed microprocessor system 30 monitors the sensors and determines if an error condition corresponding to a jam arises (step 41). If an error is detected, the distributed microprocessor system 30 implements an auto purge process 42 to be described in more detail below. If a jam still exists (step 42), for example a sensor remains covered, the system 30 stops the transaction. Otherwise the system determines if the auto purge has been carried out three times (step 44), if not the system returns to the normal deposit transaction 40. If a further jam is detected (e.g. the jam has not cleared) (step 41) then this process will repeat until within the same transaction the auto purge process 42 has been carried out three times.

In the event that the auto purge process has been carried out three times in the same transaction, the distributed microprocessor system stops the transaction on the basis that this is a jam condition which cannot be cleared even though the relevant sensor indicates after the auto purge that it has cleared.

If the transaction is stopped, the system 30 will cause the display of information identifying the likely location of the jam in a conventional manner.

The auto purge process performed by the distributed microprocessor system 30 during a withdrawal transaction will be identical in form to FIG. 2 and will not therefore be described.

In this context, a "transaction" will typically mean the processing of a single sheet through the apparatus.

Figure 3:
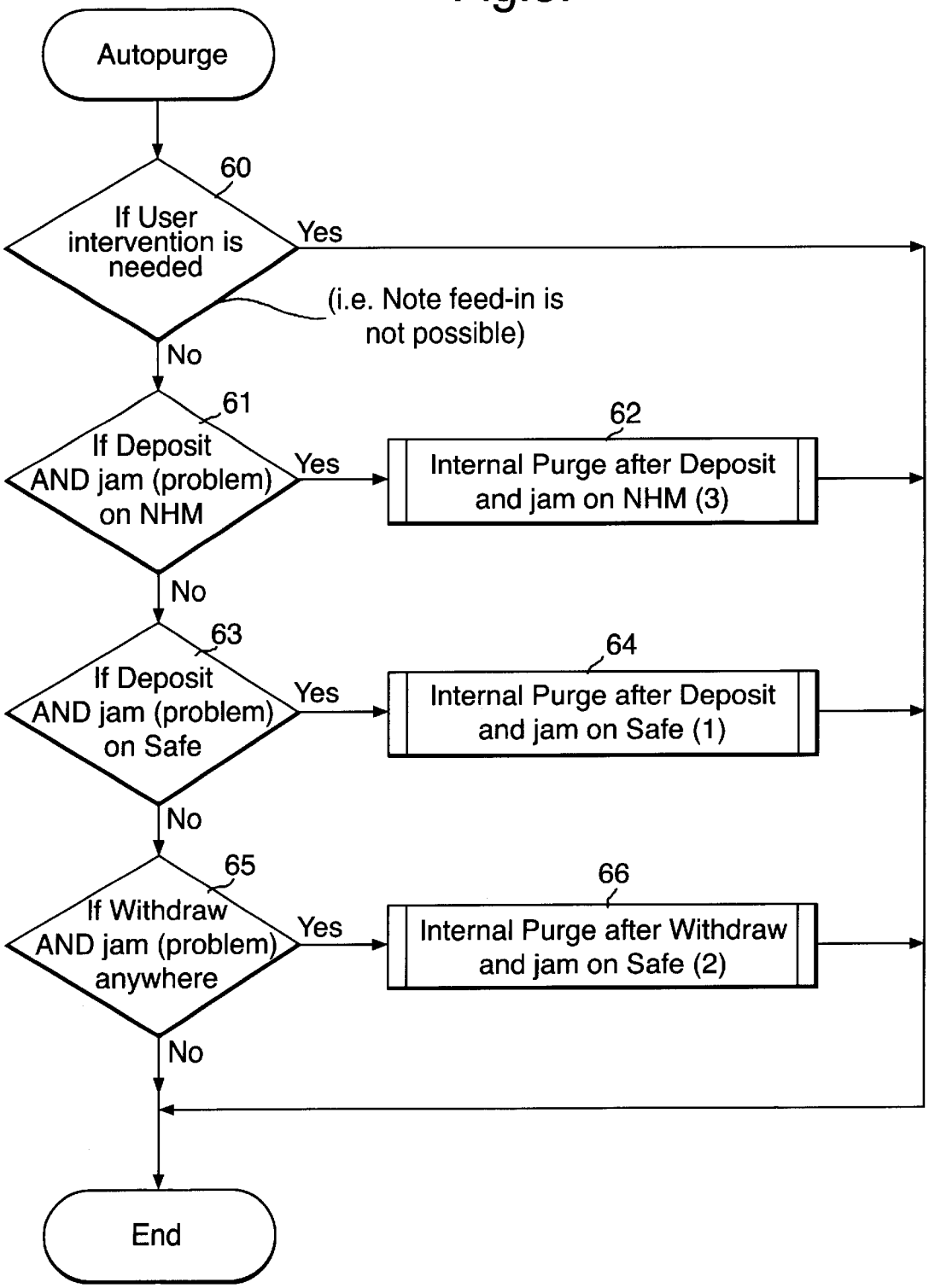

The primary steps performed by the distributed microprocessor system 30 constituting the auto purge process defined in step 42 are shown in FIG. 3.

Initially, the distributed microprocessor system 30 determines whether the jam condition (for example the location of the jam or the like) is such that user intervention is needed (step 60). If it is, then the distributed microprocessor system stops the transport system and the jam will still remain. If user intervention is not required at this stage then the distributed microprocessor system 30 determines the type of transaction and likely location of the jam. If it is a deposit transaction and the jam is in the note handling module 1 (step 61) then the process "internal purge after deposit and jam on NHM" (step 62) is performed.

If it is a deposit transaction and the jam is in the safe 10 (step 63) then the process "internal purge after deposit and jam on safe" (step 64) is performed.

Finally, if it is a withdrawal process (step 65) then the process "internal purge after withdrawal and jam on safe" (step 66) is carried out.

Figure 4:
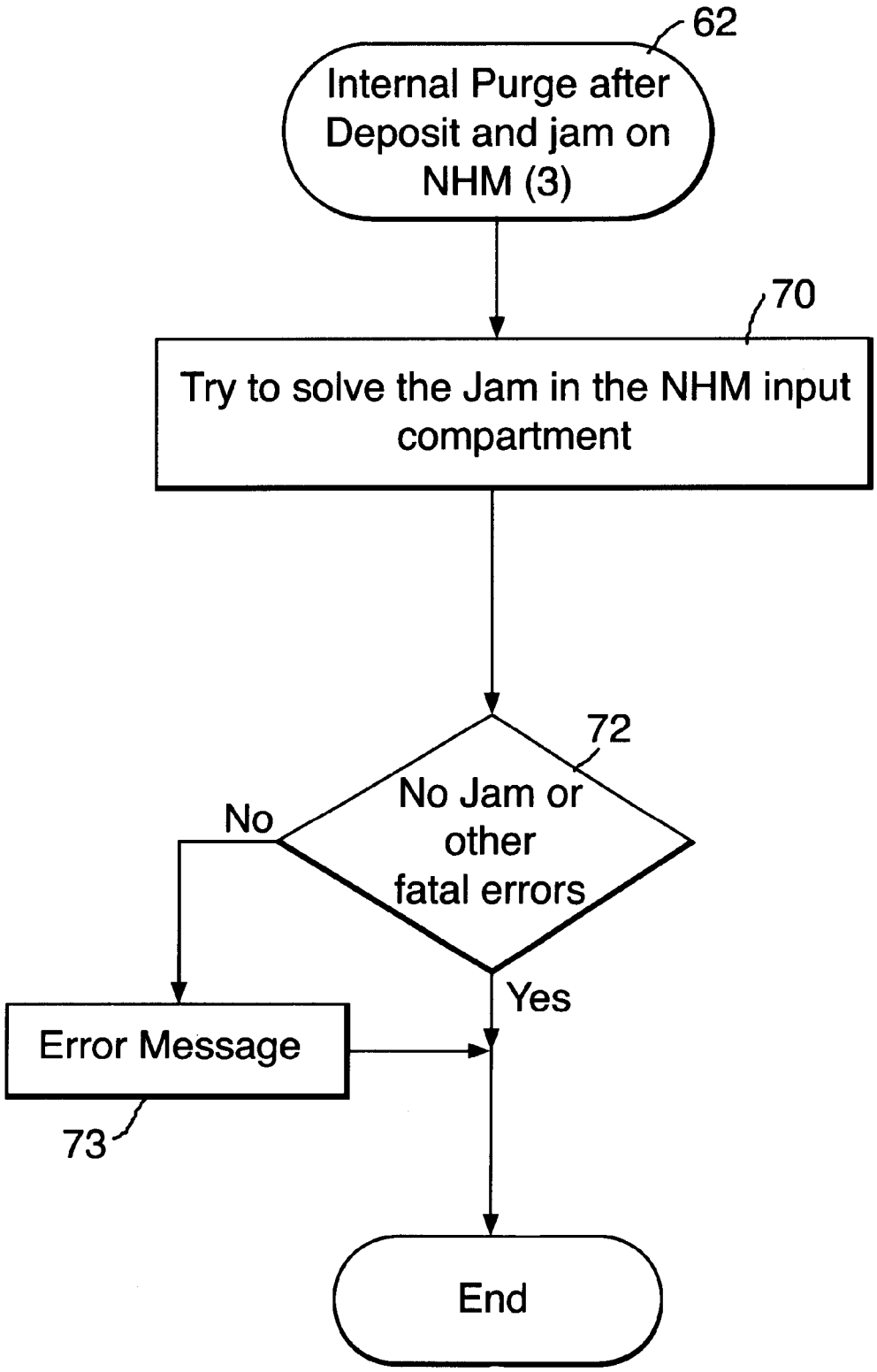

Process 62 is shown in more detail in FIG. 4. Under this condition, a jam has been detected in the note handling module 1. Consequently, the distributed microprocessor system 30 operates the motor 32 to and fro (step 70) and then in a forward direction with the diverter 5 arranged to feed notes directly to the output hopper 8. The distributed microprocessor system 30 then monitors the various sensors in the NHM 1 to see whether or not a note is still present and the jam condition exists (step 72).

If a jam still exists an error message 73 is passed to the controlling program and the user.

Figure 5:
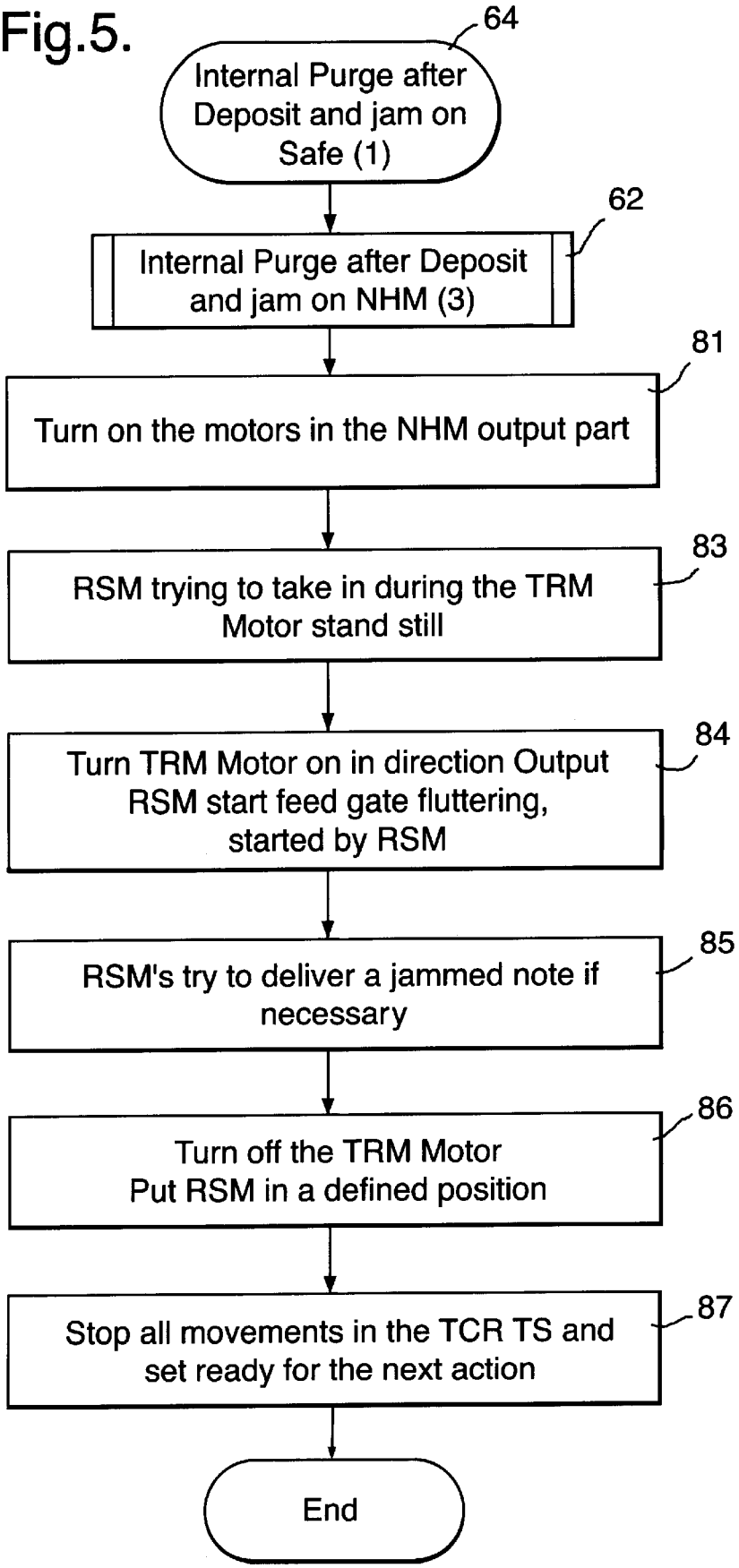

Process 64 is illustrated in more detail in FIG. 5. In this process, a jam condition has been detected in the safe 10. Initially, however, the process 62 (FIG. 4) is run to ensure that the note handling module 1 is clear of notes. The motor 32 in the NHM 1 is turned on (step 81). The distributed microprocessor system 30 then turns its attention to the RSM which should be accepting the note. The transport motor 20 is stopped and the RSM motor is activated to try to pull the jammed note into the RSM (step 83).

In step 84, the transport motor 20 is turned on in its withdrawal or output direction and the appropriate diverter 22 is moved to and from or fluttered to try to release the jammed note. If a note is released at this point, it will be fed out of the safe 10 along the feed path 19 to the NHM 1 and from there to the output hopper 8.

After a predetermined time performing step 84, the appropriate RSM is activated in its reverse, withdrawal direction to try to push a jammed note into the transport (step 85). Finally, the transport motor 20 is turned off and the RSM which was intended to receive the note set to a predefined position (step 86) and the system is reset for the passage of the next note (step 87). Between each step a check is made for jam. If a jam remains the purge process is determined and an error message is passed to the calling Program and at least to the user.

Figure 6:
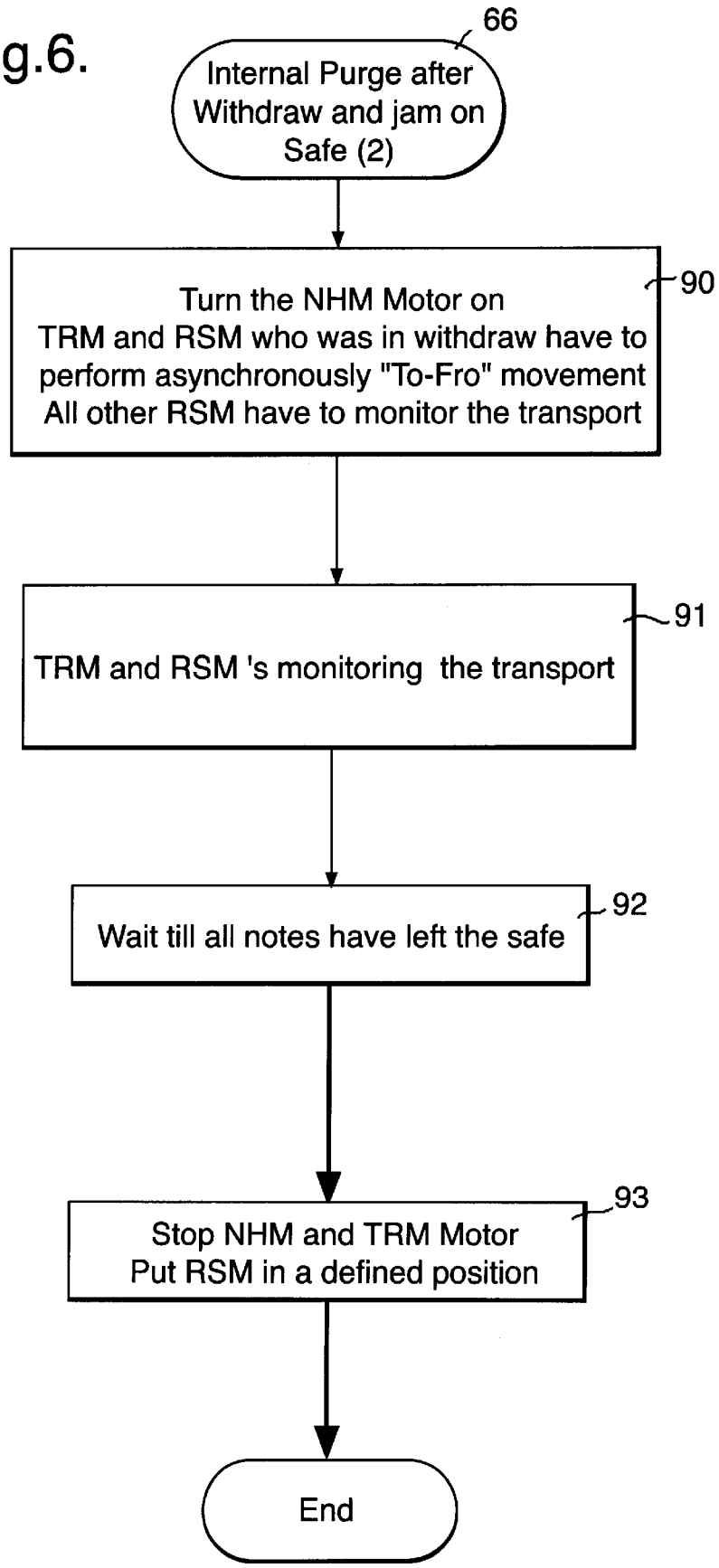

Process 66 is illustrated in more detail in FIG. 6. In a step 90 the motor 32 is activated while the motor 20 and the appropriate RSM motor are activated synchronously in a to and from motion to try and release the jammed note. Meanwhile, the sensors associated with the other RSMs and the transport defining the path 19 monitor for movement of the note (step 91). After a predetermined time, the motor 20 and the RSM motors are run in the withdrawal direction in an attempt to dispense the jammed note and they continue with this motion for sufficient time for any jammed notes to be fed to the output hopper 8 (step 92). The motors 32,20 are then stopped and the RSM concerned placed in a predefined position ready for recommencement of the withdrawal transaction (step 93). Between each step a check is made for a jam. If a jam remains, the purge process is terminated and an error message is passed to the controlling program and at least to the user.

I claim:

1. Sheet handling apparatus including a transport system for transporting sheets; a sensing system for monitoring the passage of sheets; and a controller system for determining, during a transaction involving the transport of one or a sequence of sheets, the existence of a jam condition from the sensing system, and, if a jam condition exists, a) operating the transport system to attempt to release the jammed sheet, b) determining if a jam condition still exists, and ci) if it does, stopping the transaction and, cii) if it does not, attempting to continue the transaction and wherein if the controller system determines that during a transaction a predetermined number of attempts to release the jammed sheet have been made, the controller system stops the transaction, and the controller system is adapted to operate at least part of the transport system in a reverse direction, and a to and fro motion while attempting to release a jammed sheet.

2. Sheet handling apparatus including a transport system for transporting sheets; a sensing system for monitoring the passage of sheets; and a controller system for determining, during a transaction involving the transport of one or a sequence of sheets, the existence of a jam condition from the sensing system, and, if a jam condition exists, a) operating the transport system to attempt to release the jammed sheet, b) determining if a jam condition still exists, and ci) if it does, stopping the transaction and, cii) if it does not, attempting to continue the transaction and wherein if the controller system determines that during a transaction a predetermined number of attempts to release the jammed sheet have been made, the controller system stops the transaction, and the transport system includes at least one sheet store and associated diverter, the controller system causing the diverter to move to and fro to attempt to release a jammed sheet.

3. Sheet handling apparatus including a transport system for transporting sheets; a sensing system for monitoring the passage of sheets; and a controller system for determining, during a transaction involving the transport of one or a sequence of sheets, the existence of a jam condition from the sensing system, and, if a jam condition exists, a) operating the transport system to attempt to release the jammed sheet, b) determining if a jam condition still exists, and ci) if it does, stopping the transaction and, cii) if it does not, attempting to continue the transaction and wherein if the controller system determines that during a transaction a predetermined number of attempts to release the jammed sheet have been made, the controller system stops the transaction, and the transport system includes at least one roll storage module, the controller system being adapted to cause the roll storage module to operate in a direction opposite to that required for the transaction in an attempt to release the jammed sheet.

* * * * *